US006729033B2

(12) United States Patent
Jevons et al.

(10) Patent No.: US 6,729,033 B2
(45) Date of Patent: May 4, 2004

(54) THREE DIMENSIONAL SQUARE TOOL

(76) Inventors: Robert Eugene Jevons, 4137 Cambridge, Kansas City, KS (US) 66103; Sharon Dian Lee, 4137 Cambridge, Kansas City, KS (US) 66103

( * ) Notice: Subject to any disclaimer, the term of this patent is extended or adjusted under 35 U.S.C. 154(b) by 0 days.

(21) Appl. No.: 10/061,638

(22) Filed: Jan. 31, 2002

(65) Prior Publication Data

US 2003/0140512 A1 Jul. 31, 2003

(51) Int. Cl.[7] ..... B43L 7/00
(52) U.S. Cl. ..... 33/481; 33/482
(58) Field of Search ..... 33/481, 482, 474, 33/613, 645, 475, 476, 477, 478, 479, 480, 535

(56) References Cited

U.S. PATENT DOCUMENTS 660,876 A * 10/1900 West ..... 33/480
1,032,594 A * 7/1912 Ferguson et al. ..... 33/480
1,135,259 A * 4/1915 Cokely ..... 33/481
3,276,128 A * 10/1966 Ponich ..... 33/407
3,367,224 A * 2/1968 Thiel ..... 269/57
4,361,964 A * 12/1982 Hennessee ..... 33/478
4,573,276 A * 3/1986 Torczon ..... 33/481
4,947,616 A * 8/1990 Sorton ..... 52/749.1
5,090,129 A * 2/1992 Cunningham ..... 33/481
5,142,787 A * 9/1992 Dadisman ..... 33/1 G
5,199,179 A * 4/1993 Baker ..... 33/415
5,396,707 A * 3/1995 Blase ..... 33/194
5,524,353 A * 6/1996 Fink ..... 33/451
5,720,114 A * 2/1998 Guerin ..... 33/451
5,771,597 A * 6/1998 Hopf ..... 33/474
5,813,125 A * 9/1998 Byrn ..... 33/451
5,832,913 A * 11/1998 Arends ..... 125/13.01
5,855,073 A * 1/1999 Boelling ..... 33/533
D426,127 S * 6/2000 Boelling ..... D8/71
6,327,786 B1 * 12/2001 Felix ..... 33/474
6,449,855 B1 * 9/2002 Louis ..... 33/286

* cited by examiner

*Primary Examiner*—Christopher W. Fulton
*Assistant Examiner*—Amy R. Cohen
(74) *Attorney, Agent, or Firm*—Spencer Fane Britt & Brown LLP

(57) ABSTRACT

A generally L-shaped workpiece positioning tool is provided having a base and sidewalls, said base and sidewalls having unobstructed ends and the sidewalls having a void therebetween to space apart the sidewalls.

7 Claims, 10 Drawing Sheets

THREE DIMENSIONAL SQUARE TOOL

FIELD OF THE INVENTION

The present invention relates to devices for aligning at least two workpieces at pre-selected angles. In particular, the present invention relates to a alignment tool which permits the user to use the device as a template to position at least two workpieces at a specific angle to each other without limitations on the length or width of the workpiece and without obstructions on the device which would prevent use of the device for the positioning of an outside corner or an inside corner.

BACKGROUND OF THE INVENTION

In woodworking and other endeavors, it is frequently necessary to align two workpieces at a desire angles to one another or frequently at right angles to one another. In building drawers for furniture, it is extremely important that a square or 90 degree relationship be achieved between the pieces of wood forming the sides and back of the drawer to prevent the drawer from binding in its holder within the piece of furniture. One of the particular difficulties in bringing into square two workpieces is that often more than two dimensions must be maintained in alignment for proper configuration of the workpieces. For example, in building a drawer and positioning the back of the drawer and one of the side rails into a 90 degree alignment, there are devices which will allow the user to examine and achieve a 90 degree angle between the back and the sidewall, however, with these devices, the bottom edges of the back wall and sidewall must separately be made flush with each other as the typical right angle square does not provide a base upon which the bottom edges of the drawer back and drawer sidewall may be seated during the 90 degree alignment of the back and sidewall.

Another limitation that is common with workpiece alignment tools is evidenced in a device such as that shown in U.S. Pat. No. 5,855,073 to Boelling. The device of Boelling has both front and rear sidewalls extending from a generally L-shaped base member. In addition, the device of Boelling has the ends of the sidewalls and the ends of the base member obstructed by a flange spanning from one sidewall to the other sidewall. This flange obstructs the ends of centrally positioned stem 20 (FIG. 1) and prevents situating workpieces which are longer than stem 20 on the inside of the device so that the bottoms of the workpieces might be aligned by contact with stem 20.

Another example of devices having obstructions which can interfere with the alignment of two workpieces can be found in U.S. Pat. No. 5,312,078 to Marsh. The device of Marsh, while intended to secure corners during shipping, might be considered as a device which could be used to align two workpieces along the insides of arm members 22', 23' (FIG. 6 of Marsh). However, the device of Marsh contains strut member 46', 47' on the inside surface which would hold the workpieces away from arm members 22', 23' and allow the ends of the workpieces to pivot on strut members 46', 47' thus inhibiting proper alignment of the workpieces. Similarly, the device of Marsh contains obstructions on the outside edge which would prevent the use of the outside of Marsh for alignment of workpieces.

Yet another device for squaring can be seen in U.S. Pat. No. 4,805,315 to Nesbitt. The device of Nesbitt is a frame-like device having no base member upon which the bottom edge of a workpiece could be rested to ensure that the bottom edges of the workpieces are in flush alignment.

Further, the device of Nesbitt only allows the outside of members 10, 12 and 30 to be used in supporting workpieces in position. Attempts to use the inside perimeter of Nesbitt is confronted with closed off ends of every angle.

Therefore, it is an object of the present invention to provide a workpiece alignment tool which can operate in three dimensions to produce a 90 degree, or other pre-selected angle of alignment between workpieces and provide flush alignment of the bottom edges of the workpieces.

It is another object of the present invention to provide a workpiece alignment tool which has ends which are unobstructed and, therefore, can accommodate workpieces of any length.

It is another object of the present invention to provide a workpiece alignment tool which has sidewalls which are spaced apart at their ends which are adjacent to one another to accommodate the exuding of a bead of glue from the joint and, thereby, avoid spreading the glue on the finished surfaces of the workpiece.

It is another object of the present invention to provide a workpiece alignment tool which has sidewalls which are spaced apart at their ends which are adjacent to one another to accommodate the mitered or beveled point of a workpiece therein and thereby provide a tight fit between the alignment tool and the workpieces.

Yet another object of the present invention is to provide a workpiece alignment tool which allows simple and easy clamping of workpieces in precise, angular relationships.

Still another object of the present invention is to provide a workpiece alignment device which has multiple working surfaces to allow the use of the alignment tool on the inside of the corner or the outside of the corner of two workpieces which are being aligned at a pre-selected angle.

SUMMARY OF THE INVENTION

The above objects and more are accomplished in a alignment tool which provides a generally L-shaped base member having unobstructed leg ends and an unobstructed front edge and having attached to the back edge of the base member first and second sidewalls which also are unobstructed at their ends and which are spaced apart from each other by a void, the void permitting excess glue to be squeezed out of a joint between two workpieces being assembled in the tool and also to permit the points of two mitered or beveled edges to reside in the void when mitered or beveled edges, such as those of a picture frame, are being assembled. The alignment tool can, in various preferred embodiments provide alignment at any pre-selected angle at which the tool is formed during manufacture such as ninty degrees or forty-five degrees or twenty degrees or any other pre-selected angle.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DESCRIPTION OF THE PREFERRED EMBODIMENT

As required, detailed embodiments of the present inventions are disclosed herein; however, it is to be understood that the disclosed embodiments are merely exemplary of the invention, which may be embodied in various forms. Therefore, specific structural and functional details disclosed herein are not to be interpreted a limiting, but merely as a basis for the claims and as a representative basis for teaching one skilled in the art to variously employ the present invention in virtually any appropriately detailed structure.

Figure 1:
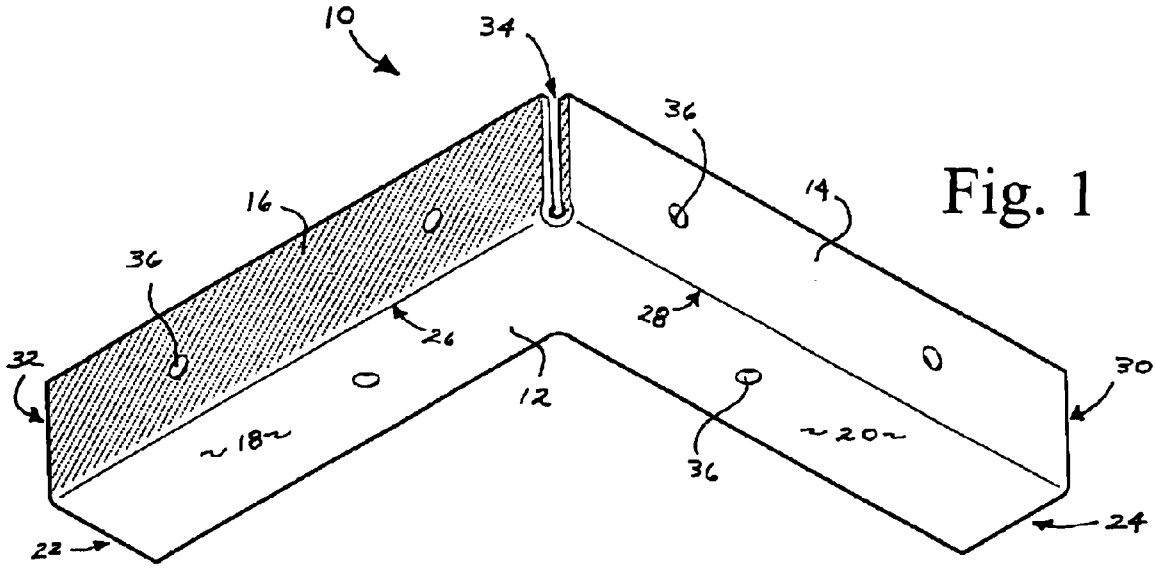
FIG. 1 is a bottom and outside perspective view of the base and sidewalls of a 90 degree embodiment of the present invention.

Referring to FIG. 1, alignment tool 10 is shown in a bottom and outside perspective view. Squaring tool 10 is comprised of base member 12 which is a flat, generally L-shaped base piece and to which first sidewall 14 and second sidewall 16 are connected. In the preferred embodiment of the present invention, first sidewall 14 and second sidewall 16 are integrally formed with base member 12. Legs 18 and 20 of base member 12 extend away from their junction and terminate in leg ends 22, 24. Leg ends 22, 24 will be more particularly described hereinafter. Similarly, first sidewall 14 and second sidewall 16, which are connected to base member 12 along back edge 26, 28 of base member 12, extend outwardly toward leg ends 22, 24 where first sidewall 14 terminates at first sidewall end 30 and second sidewall 16 terminates at second sidewall end 32. At the opposite end from sidewall ends 30, 32 of sidewalls 14,16 is void 34 which spaces apart first sidewall 14 from second sidewall 16. Base member 12 and first sidewall 14 and second sidewall 16 are further equipped with securing voids 36 which may be used by the user to secure alignment tool 10 to workpieces through the use of screws or nails. The outside surfaces of sidewalls 14, 16 have, in a preferred embodiment been machine milled to provide an outside 90° angle having a precision of plus or minus 0.0002 of an inch. Those skilled in the art will appreciate that embodiments of the present invention can be formed at any pre-selected angle and also precision machine.

For example commonly used angles of sixty degrees, forty-five degrees, thirty degrees and/or twenty-two and one-half degrees could be used to form the angle between first and second sidewalls 14,16.

Figure 2:
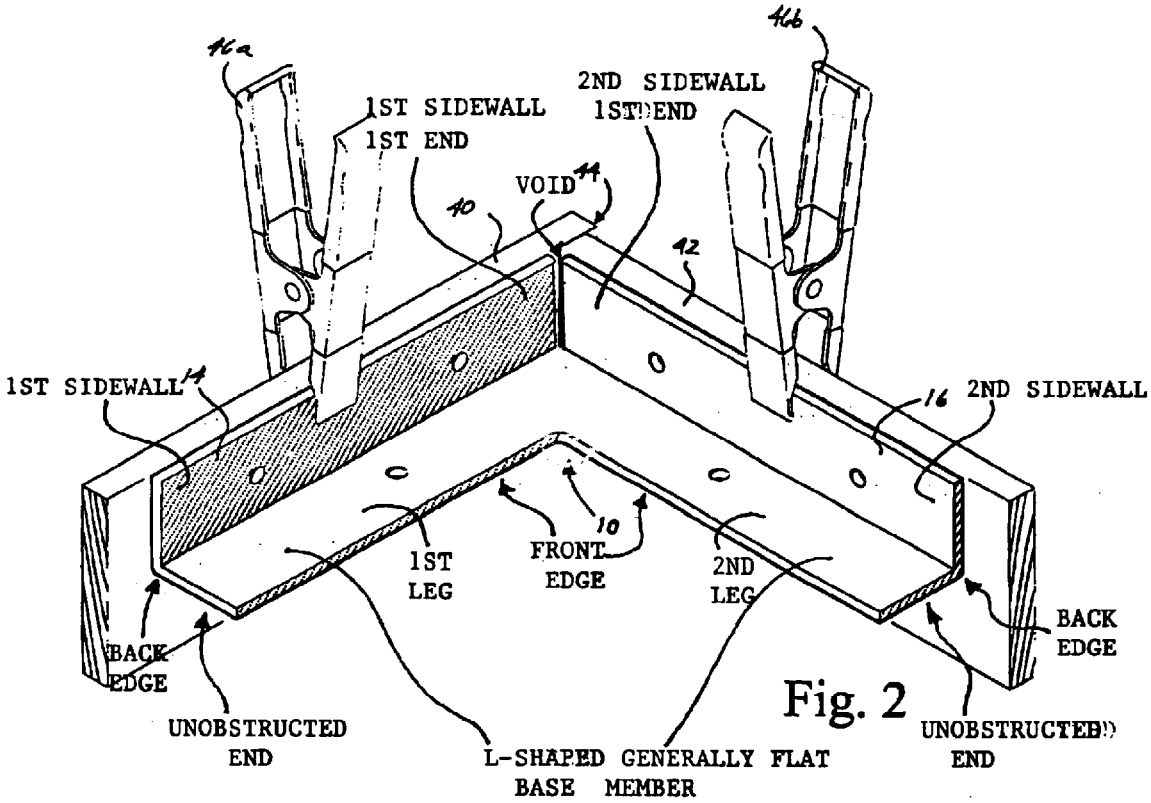
FIG. 2 shows the outside sidewall surfaces of a 90 degree embodiment of the present invention being used to clamp together two workpieces against the sidewalls of the invention to produce a pre-selected 90 degree angle.

Referring now to FIG. 2, the use and operation of the present invention will be described. In FIG. 2, the present invention is used to align a first workpiece 40 and a second workpiece 42 in a right angle alignment. Those skilled in the art will appreciate that the outside of alignment tool 10 has been used so that end 44 of workpiece 40 can extend beyond workpiece 42 without interfering with the square or 90 degree alignment between workpiece 40 and workpiece 42. It further can be appreciated in FIG. 2 that to secure workpieces to tool 10, clamps 46*a*, 46*b* can be quickly and easily used to hold workpieces in place against alignment tool 10.

Figure 3:
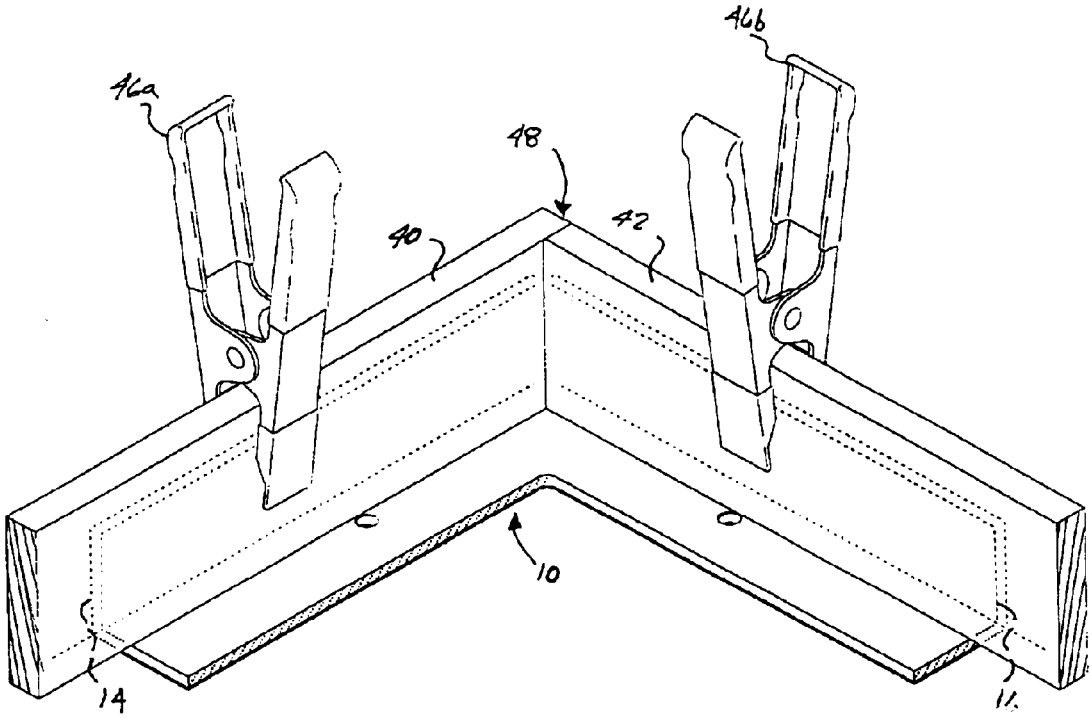
FIG. 3 shows the use of the inside sidewalls of the present invention to secure two workpieces to the inside of the device to produce a 90 degree angle between the two workpieces and using the base member of the present invention to ensure a flush relationship between the bottom edges of the two workpieces.

Referring now to FIG. 3, the use of the inside of first sidewall 14 and second sidewall 16 to achieve 90 degree alignment between workpieces is shown. It will be appreciated by those skilled in the art that use of the inside face of first sidewall 14 and second sidewall 16 is used where a flush, outside edge 48 is desired between workpieces 40, 42. In FIG. 3 as in FIG. 2, it can be appreciated that workpieces which extend past leg ends 22, 24 and sidewall ends 30, 32 are easily accommodated by tool 10 as there is no obstruction of leg ends 22, 24 or sidewall end 30, 32 as there is with other such devices. Again, as shown in FIG. 3 when it is wished to avoid marring the surface of a workpiece, clamps 46*a*, 46*b* may be used to secure workpieces 40, 42 to tool 10 as an alternative to driving screws through voids 36 (FIG. 1) to secure workpieces 40, 42.

Figure 4:
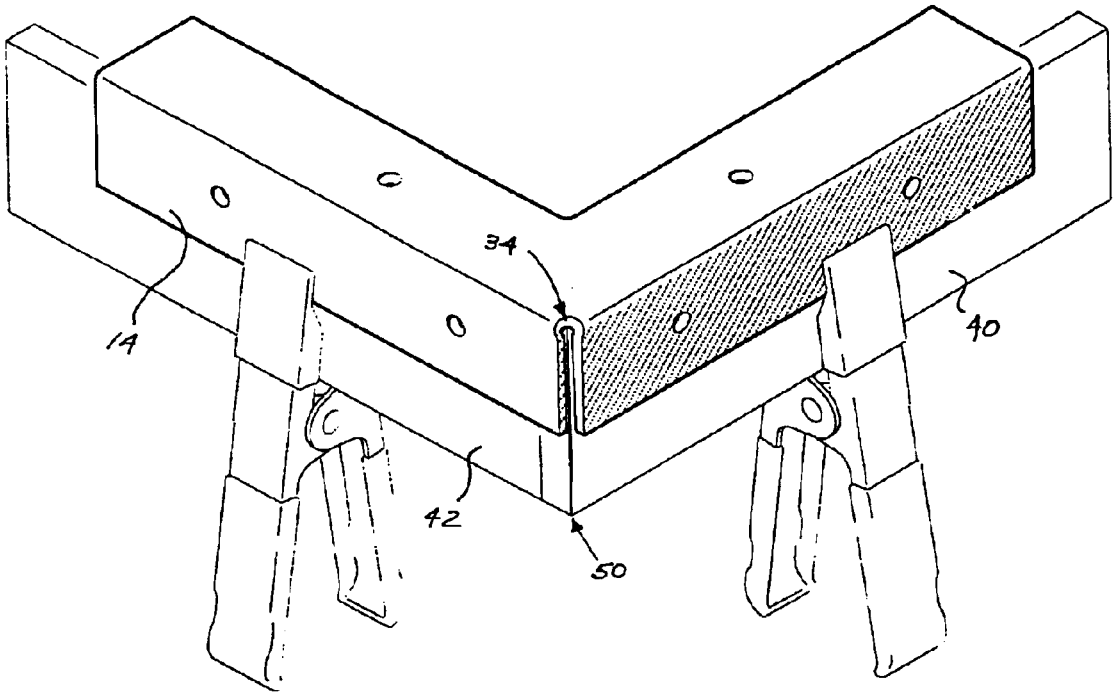
FIG. 4 shows the use of the invention shown in FIG. 4 from the outside and with the device inverted and showing the spacing between the sidewalls of the invention to allow the escape of glue and/or insertion of a pointed edge of one of the workpieces.

Referring now to FIG. 4, the application of alignment tool 10 which was previously described in FIG. 3 is again shown in FIG. 4, however, this view being from the outside of the device and with the device and workpieces inverted. It will be appreciated that flush outside edge 48 (FIG. 3) of workpieces 40, 42 presents an edge 50 of workpiece 40 as the outermost extending portion of workpieces 40, 42. In many conventional squaring devices which are not provided with a void 34, edge 50 of the workpieces is butted against the inside corner of the squaring device and can prevent full and secure contact between workpiece 40 and sidewall 16 and workpiece 42 and sidewall 14. The spacing apart of sidewalls 16, 14 through the use of void 34 allows a pointed edge 50 to be accommodated and prevents interference with proper alignment of workpieces 40, 42 against sidewalls 14, 16.

Figure 5:
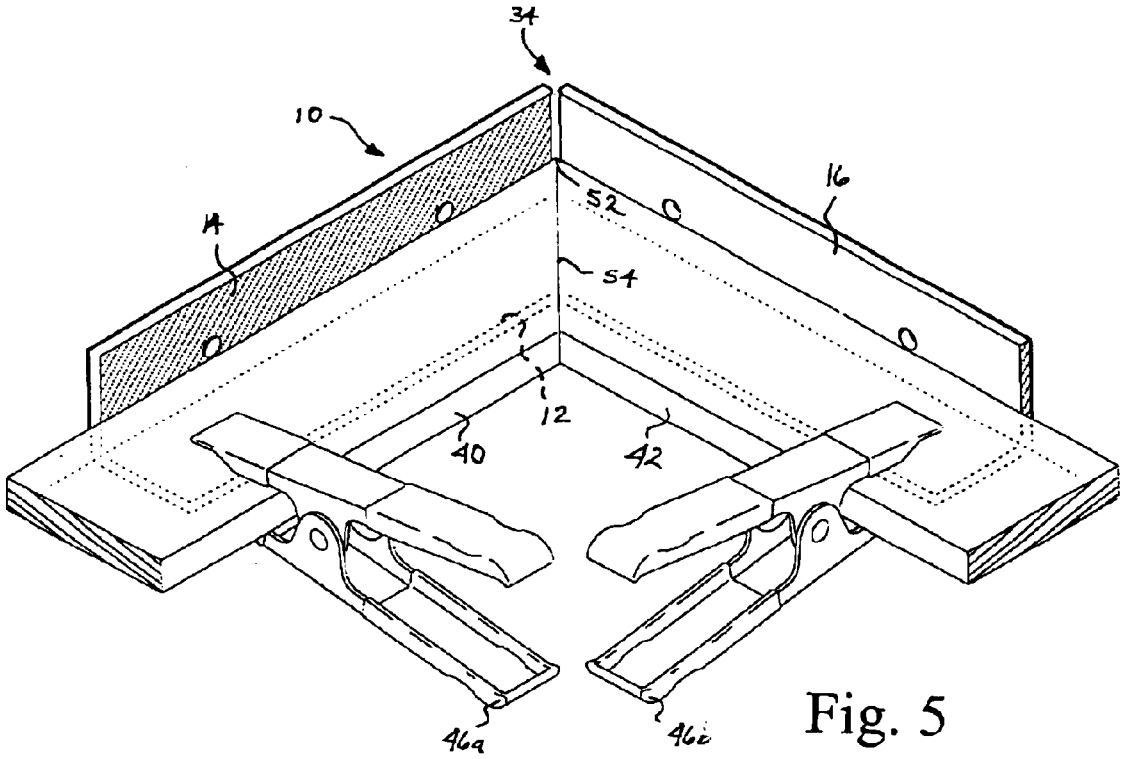
FIG. 5 shows the use of the base member to support two workpieces being joined together at a mitered corner and showing the insertion of the outside point of the mitered corner into the void between the sidewalls of the present invention.

Referring now to FIG. 5, tool 10 is shown being used to assemble workpieces 40, 42. In this instance the workpieces are being assembled with a mitered joint between workpieces 40, 42. In FIG. 5, the importance of void 34 is again demonstrated as void 34 is able to accommodate the point 52 of mitered joint 54 without interfering with complete contact between workpieces 40, 42 and sidewalls 14, 16. Those skilled in the art will appreciate that in the use of tool 10 that base member 12 is used to provide a flush surface between workpieces 40, 42.

Figure 6:
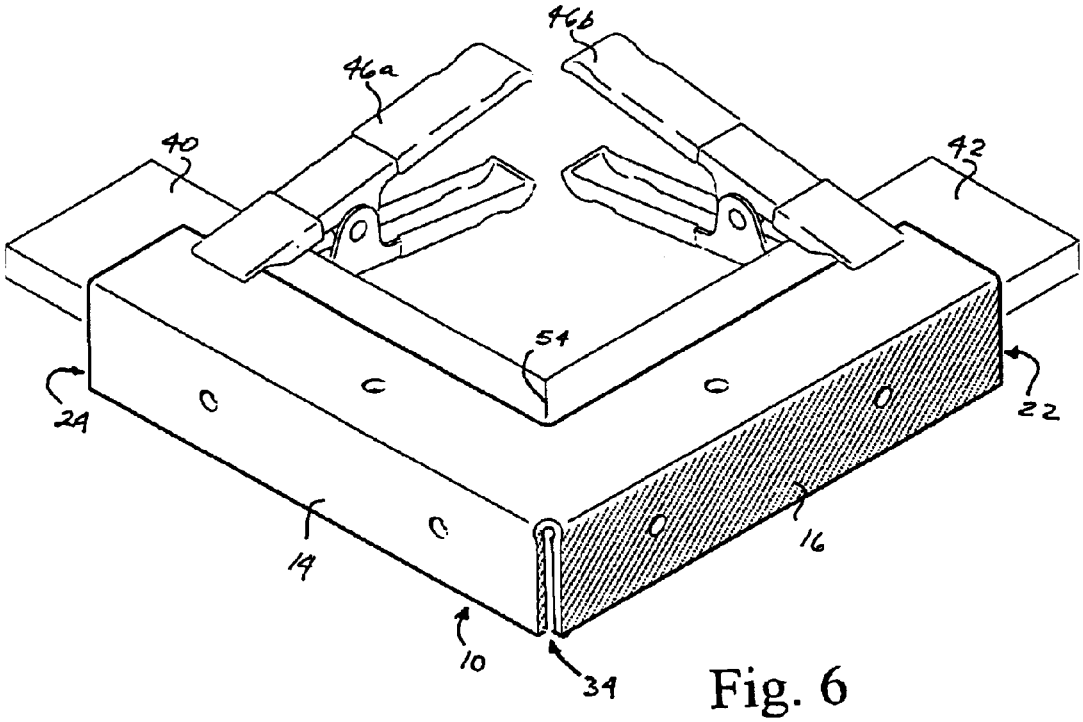
FIG. 6 shows the use of the present invention as shown in FIG. 5 from an outside and inverted perspective.
Figure 7:
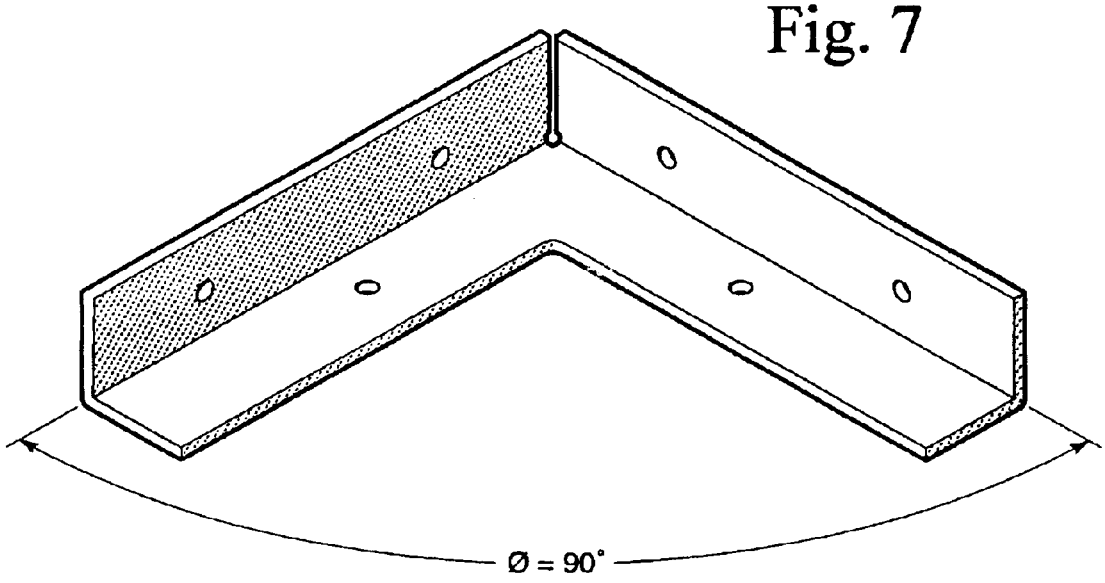
FIG. 7 is a perspective view of the invention showing the inside sidewalls of the present invention and showing the first and second legs of the generally flat base member joined at a 90 degree angle.
Figure 8:
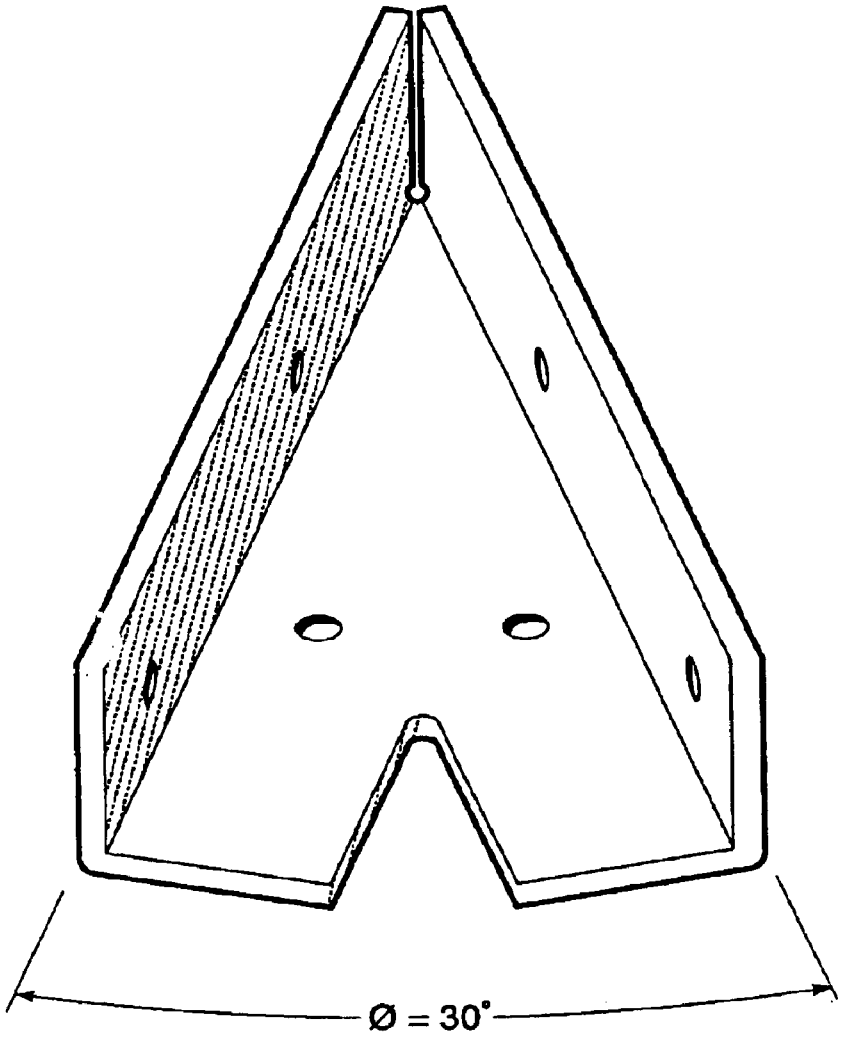
FIG. 8 is a perspective view of the invention showing the inside sidewalls of the present invention and showing the first and second legs of the generally flat base member joined at a 30 degree angle.
Figure 9:
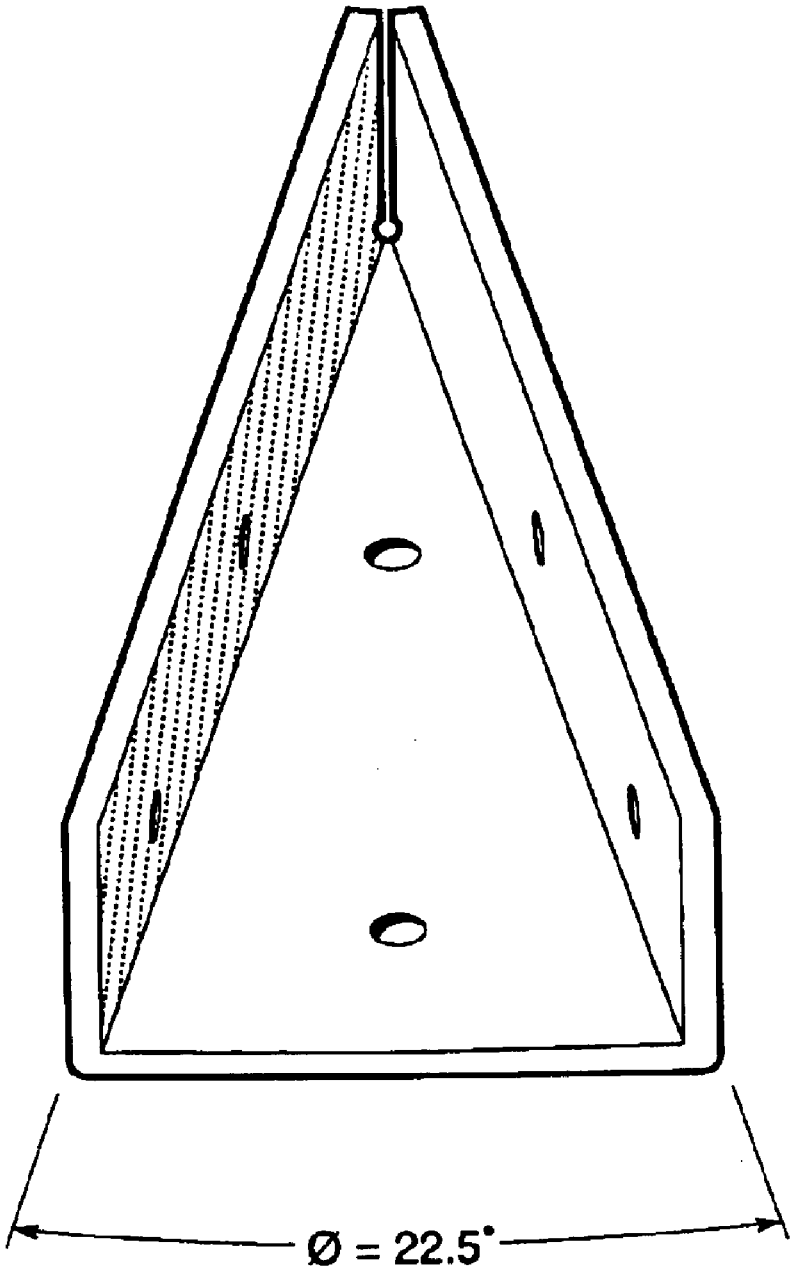
FIG. 9 is a perspective view of the invention showing the inside sidewalls of the present invention and showing the first and second legs of the generally flat base member joined at a 22.5 degree angle.
Figure 10:
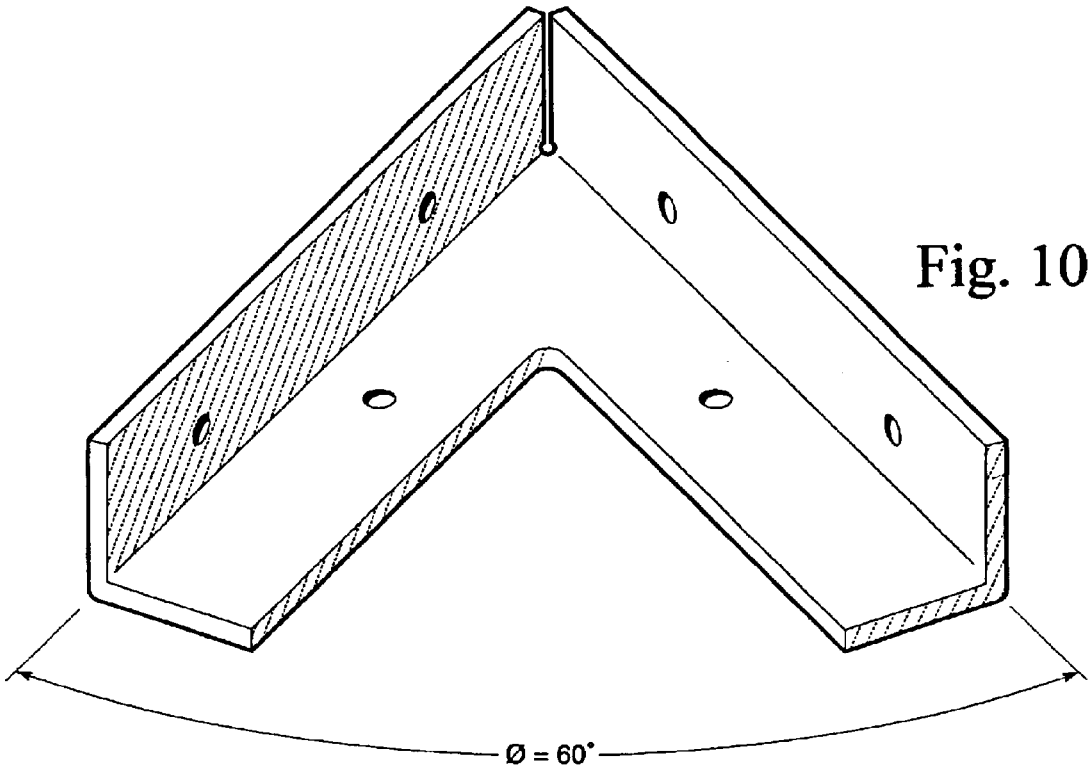
FIG. 10 is a perspective view of the invention showing the inside sidewalls of the present invention and showing the first and second legs of the generally flat base member joined at a 60 degree angle.
Figure 11:
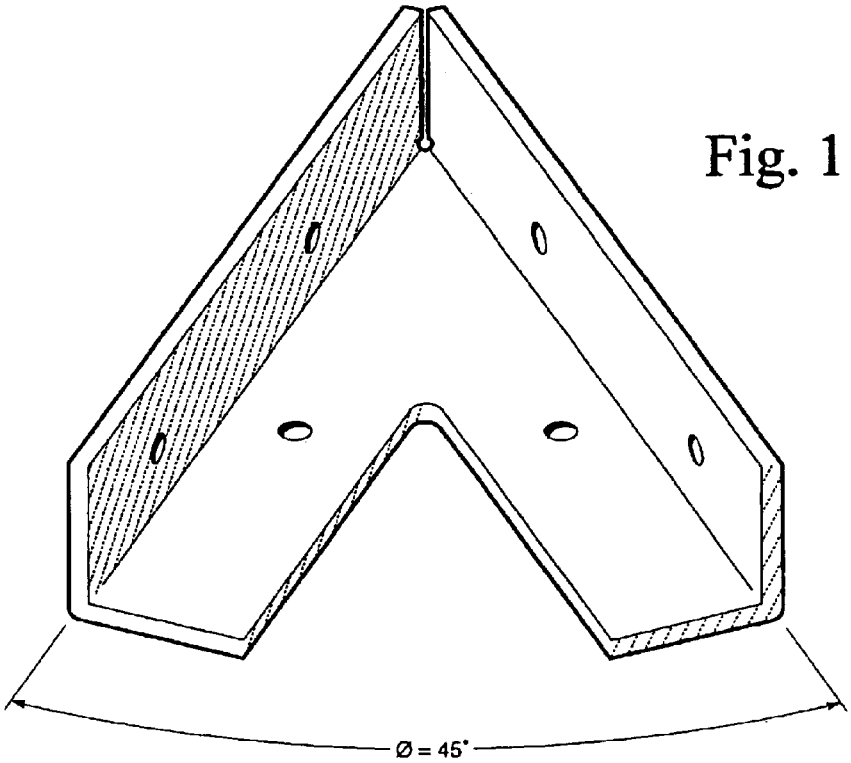
FIG. 11 is a perspective view of the invention showing the inside sidewalls of the present invention and showing the first and second legs of the generally flat base member joined at a 45 degree angle.

Referring now to FIG. 6, the application shown in FIG. 5 of tool 10 to a mitered joint between workpieces 40, 42 is shown from the outside and with the tool and workpieces inverted. Once again, it can be appreciated that though the ends of workpieces 40, 42 extend well beyond leg end 22, 24 of base member 12, that no obstruction is present to prevent the use of tool 10 to assemble workpieces of greater length than the length of tool 10 itself. Another important utility of void 34 is to permit glue to escape which is exuded from a joint such as mitered joint 54. In alignment tools which have a joined corner between sidewalls 14, 16, the exuded glue from the compression of workpieces 40, 42 along joint 54 will be pressed outwardly along sidewalls 14, 16. It will be appreciated by those skilled in the art that while many edges of joint 54 are accessible and the glue could be wiped clean of the workpieces before the glue set, that the corner in a device having sidewalls 14, 16 which are joined together would not be able to be reached for removal. In such a case, the glue would hardened and the user would need to resort to a method of abrasion to clean the glue from the finished surface of the workpieces.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described. Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the inventive alignment tool is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A workpiece positioning tool comprising:

a generally flat base member for supporting a workpiece thereon, said base member having first and second legs joined at an angle, said first and second legs having front edges and back edges and leg ends opposing a point at which said first and second legs are joined, said leg ends and front edges of said first and second legs being unobstructed, wherein said front edges are located along an interior of said angle and said back edges are located along an exterior of said angle, a first sidewall connected to said back edge of said base member first leg at a generally right angle to said flat base member, a second sidewall connected to said back edge of said base member second leg at a generally right angle to said flat base member, said second sidewall having a first end adjacent said first sidewall and an unobstructed second end, and said first sidewall having a first end adjacent said second sidewall, and an unobstructed second end, a void extending upwardly from said base member and between said first and second adjacent ends.

2. The workpiece positioning tool as claimed in claim 1 further comprising a plurality of voids in said base member and said first and second sidewalls for securing the tool to a workpiece.

3. The workpiece positioning tool as claimed in claim 1 wherein said first and second legs of said generally flat base member are joined at a 22.5 degree angle.

4. The workpiece positioning tool as claimed in claim 1 wherein said first and second legs of said generally flat base member are joined at a 30 degree angle.

5. The workpiece positioning tool as claimed in claim 1 wherein said first and second legs of said generally flat base member are joined at a 45 degree angle.

6. The workpiece positioning tool as claimed in claim 1 wherein said first and second legs of said generally flat base member are joined at a 60 degree angle.

7. The workpiece positioning tool as claimed in claim 1 wherein said first and second legs of said generally flat base member are joined at a 90 degree angle.

* * * * *